US009133688B2

(12) United States Patent
Jancha et al.

(10) Patent No.: US 9,133,688 B2
(45) Date of Patent: Sep. 15, 2015

(54) INTEGRAL MULTIPLE STAGE SAFETY VALVES

(75) Inventors: Robert A. Jancha, Porter, TX (US); Thomas G. Hill, Jr., Conroe, TX (US)

(73) Assignee: Tejas Research & Engineering, LLC, The Woodlands, TX (US)

( * ) Notice: Subject to any disclaimer, the term of this patent is extended or adjusted under 35 U.S.C. 154(b) by 239 days.

(21) Appl. No.: 13/566,164

(22) Filed: Aug. 3, 2012

(65) Prior Publication Data

US 2014/0034325 A1 Feb. 6, 2014

(51) Int. Cl.

| | |
|---|---|
| ***E21B 34/06*** | (2006.01) |
| ***E21B 34/10*** | (2006.01) |
| ***E21B 34/12*** | (2006.01) |
| *E21B 34/00* | (2006.01) |

(52) U.S. Cl.

CPC ..... *E21B 34/10* (2013.01); *E21B 34/12* (2013.01); *E21B 2034/005* (2013.01)

(58) Field of Classification Search

CPC ... E21B 34/10; E21B 34/14; E21B 2034/005; E21B 34/06; E21B 43/12; E21B 34/16; E21B 34/12

USPC ..... 166/386, 332.8, 373, 321, 375; 137/613; 251/58

See application file for complete search history.

(56) References Cited

U.S. PATENT DOCUMENTS

| | | | | |
|---|---|---|---|---|
| 4,605,070 | A | 8/1986 | Morris | |
| 4,846,281 | A | 7/1989 | Clary et al. | |
| 6,152,229 | A | 11/2000 | Jennings | |
| 6,237,693 | B1 * | 5/2001 | Deaton | 166/375 |
| 6,302,210 | B1 * | 10/2001 | Crow et al. | 166/324 |
| 6,394,187 | B1 | 5/2002 | Dickson et al. | |
| 6,880,641 | B2 * | 4/2005 | Dennistoun et al. | 166/375 |
| 7,392,849 | B2 | 7/2008 | Lauderdale et al. | |
| 7,510,010 | B2 | 3/2009 | Williamson | |
| 7,673,689 | B2 | 3/2010 | Jackson et al. | |
| 7,798,229 | B2 | 9/2010 | Vick, Jr. | |
| 2002/0074129 | A1 * | 6/2002 | Moore | 166/375 |
| 2004/0154803 | A1 * | 8/2004 | Anderson et al. | 166/332.8 |
| 2011/0220367 | A1 | 9/2011 | Browne | |
| 2012/0085548 | A1 * | 4/2012 | Fleckenstein et al. | 166/373 |
| 2012/0138309 | A1 | 6/2012 | Lake | |

OTHER PUBLICATIONS

Patent Cooperation Treaty—International Search Report and Written Opinion; mailing date Dec. 19, 2013; pp. 1-9.

* cited by examiner

*Primary Examiner* — Daniel P Stephenson
(74) *Attorney, Agent, or Firm* — Tumey L.L.P.

(57) ABSTRACT

An integral multistage safety valve is designed to provide a second level of protection should a first stage fail. The valve may be used in oil and/or gas wells. The interior portion of the multiphase safety valve is designed so as to reduce turbulence and pressure loss through the valve when the valve is in an open position. The valves may be independently operable, or operable with a single control line. The multi-stage valve reduces the number of body joints required to construct two identical valves thereby reducing cost and potential leak paths and increasing reliability of the system.

13 Claims, 6 Drawing Sheets

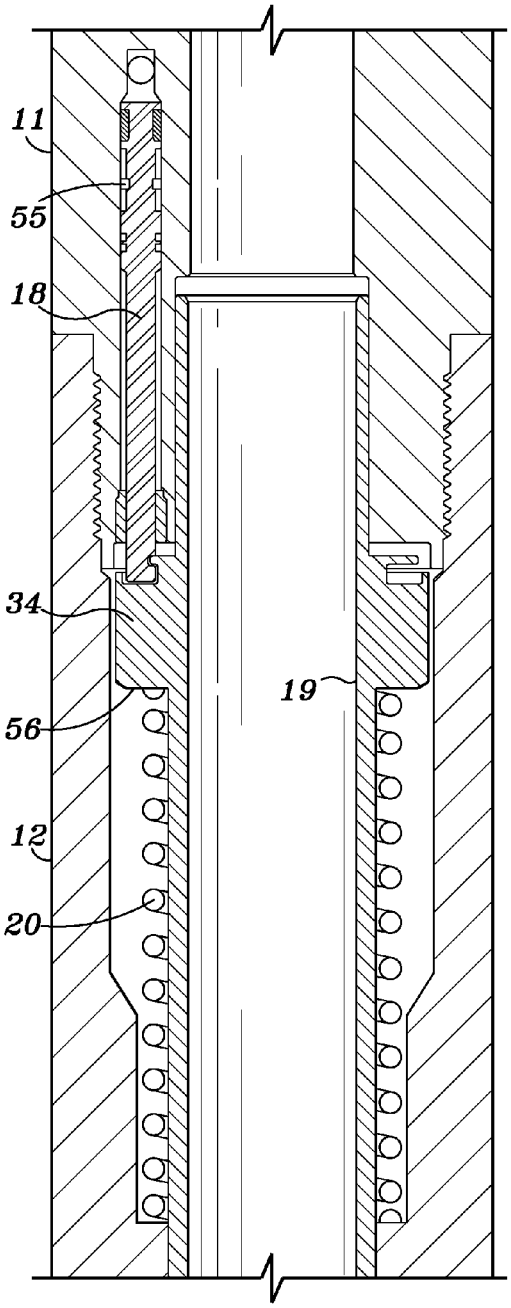
FIG. 4
FIG. 5
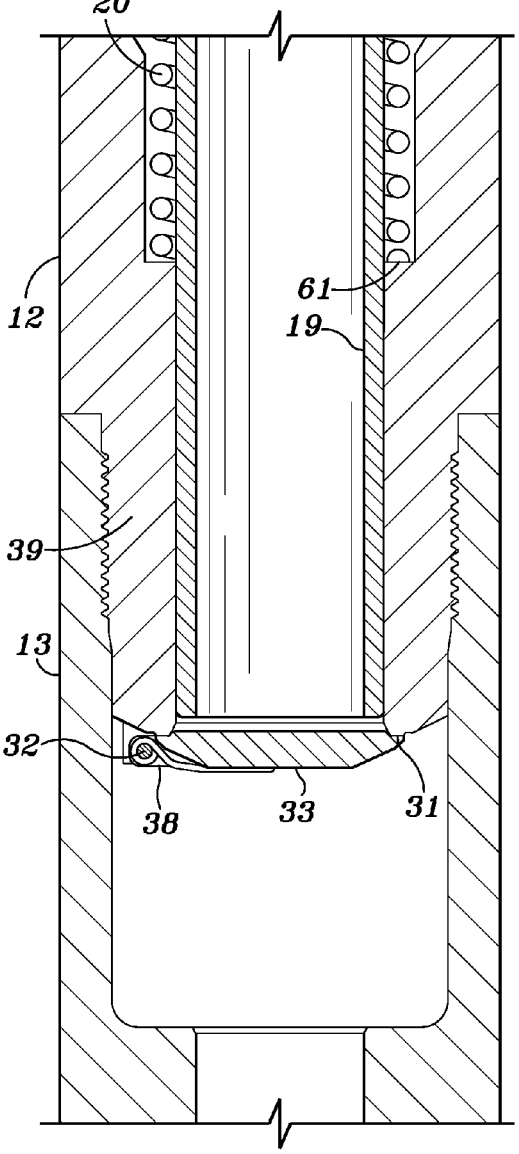

INTEGRAL MULTIPLE STAGE SAFETY VALVES

BACKGROUND OF INVENTION

1. Field of the Invention

This invention is for multiple safety valves for location within an oil or gas well that can be activated to open or close and thus prevent, or permit upward flow of fluids within the well for example in case of an emergency.

2. Description of Related Art

Downhole safety valves are known that include a housing, a flapper valve and a remotely controlled actuator for closing the normally open valve in case of an emergency. See for example U.S. Pat. No. 7,392,849. Also serially arranged valves in a downhole tool are also known. Examples of such are shown in U.S. Pat. Nos. 6,394,187; 7,673,689; 4,846,281; 4,605,070; and 6,152,229. These valves are complicated in design and are not compact as is critical in the art. Furthermore the internal flow passage for the fluids are not of a single diameter and many contain obstruction shoulders or changes in diameter that result in turbulent flow or pressure drops.

Threaded joints are in common use in hydrocarbon producing wells. During design qualification of subsurface safety valves, a body joint must be designed qualified and verified which is an expensive process, because of the consequences of a leak in a valve of this type. Typical solutions would be to provide valves with two body joints and a pup joint between which adds two additional body joints. The present invention reduces the number of body joints in an integral valve to four or five and utilizes the same body joint.

BRIEF SUMMARY OF THE INVENTION

The invention disclosed and claimed in this application is for subsurface multiple stage safety valves that are highly reliable, compact, simple to manufacture and include at least two complete, separately functioning safety valves. In accordance with another aspect of the invention, dual control lines are provided which allows for individual operation of each safety valve. This allows the operator the option of operating one valve and keeping the other as a stand-by or operating both valves simultaneously. The principles of the invention can be applied to pressure equalizing or non-pressure equalizing closing systems. Due to the internal design of the valve, the internal flow path is substantially of uniform diameter thus eliminating turbulence and pressure drops due to internal obstructions and irregularities. Furthermore the exterior diameter of the tool is substantially constant. The tool includes a minimum of body joints which increases the reliability of the tool and simplifies construction.

Another advantage of the valve is the reduction of body joints necessary for its construction. Reducing the number of body joints reduces potential leak paths of hydrocarbons from the inside. Fewer joints also reduces the cost of the body joint.

Another embodiment of the present invention is to operate both valves with a single control line, which controls the sequence of openings and closures.

BRIEF DESCRIPTION OF THE SEVERAL VIEWS OF THE DRAWING(S)

FIG. 1 is a longitudinal sectional view of an embodiment of the invention.

FIGS. 2*a* and 2*b* are cross sectional views of an embodiment of the multiple stage safety valve in the closed position.

FIGS. 3*a* and 3*b* are cross sectional views of an embodiment of the multiple stage safety valve in the open position.

FIGS. 4 and 5 are cross sectional views of an example of a piston operated sleeve.

DETAILED DESCRIPTION OF THE INVENTION

Initially, in order to better understand the invention, the prior art will be discussed. Currently in order to provide redundancy, two valves are simply joined together by a pup joint. The upper valve is connected to production tubing by a threaded connection and the lower valve is connected to lower production tubing by a threaded connection. This results in six body joints. As discussed above these body joints increase the likelihood of leak passages and increase the cost of fabrication.

Figure 1:
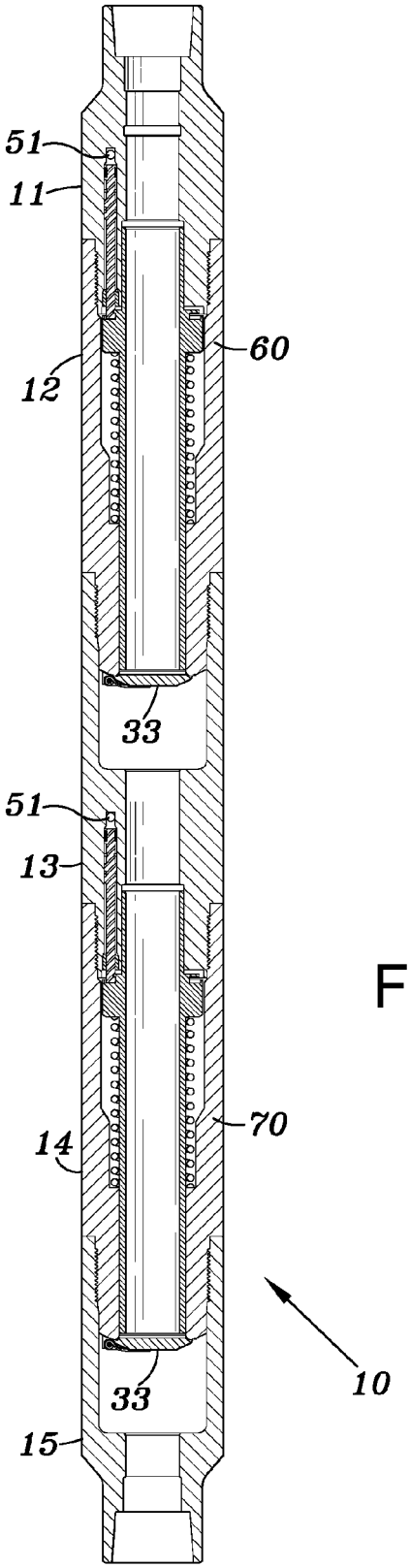
Figure 2A:
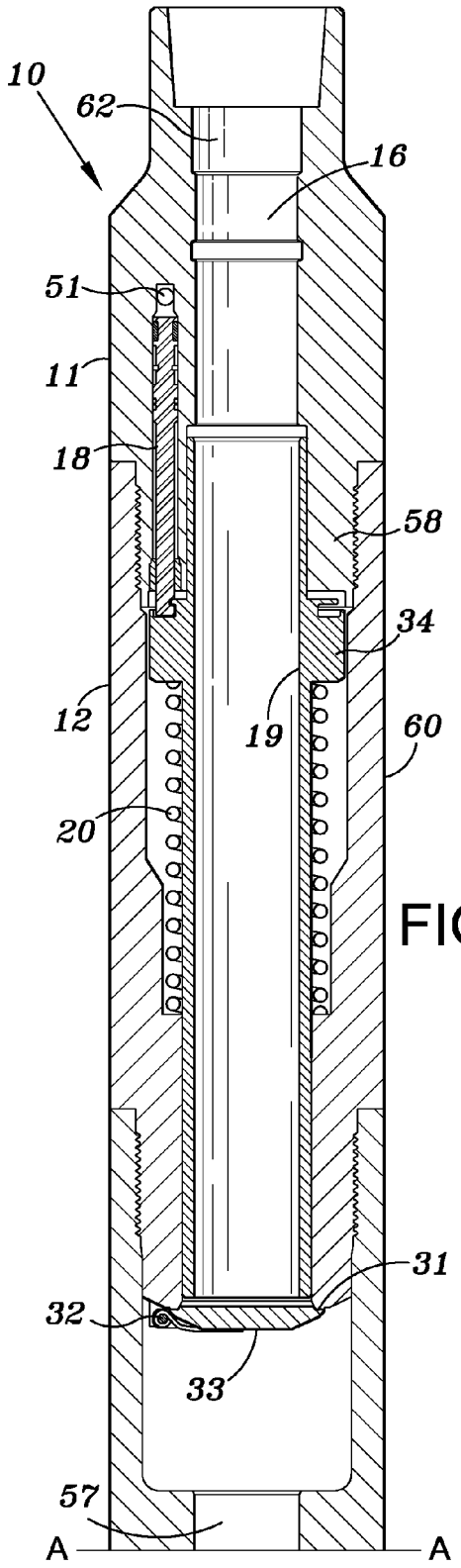
Figure 2B:
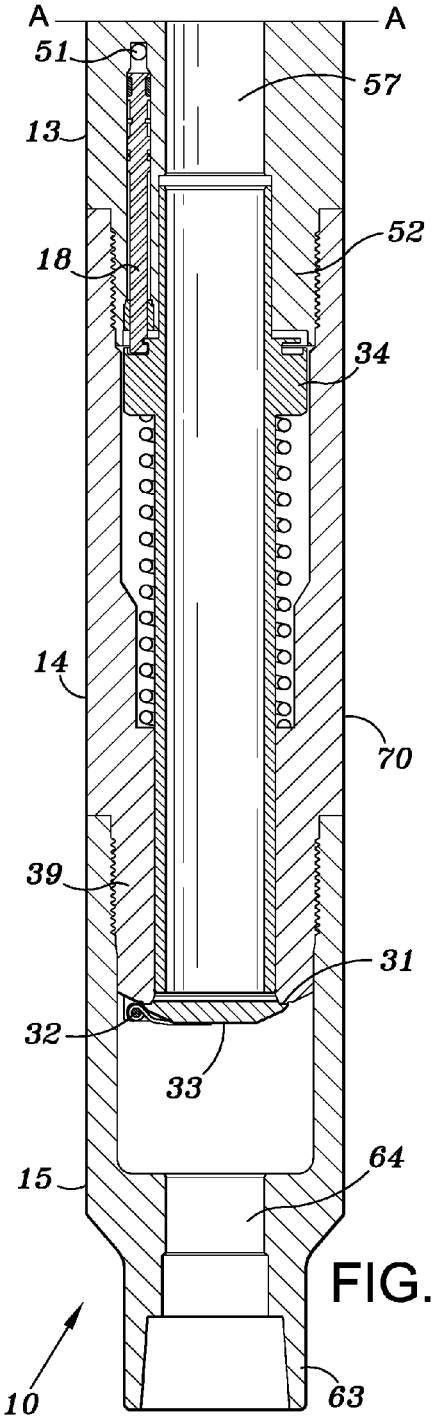
Figure 3B:
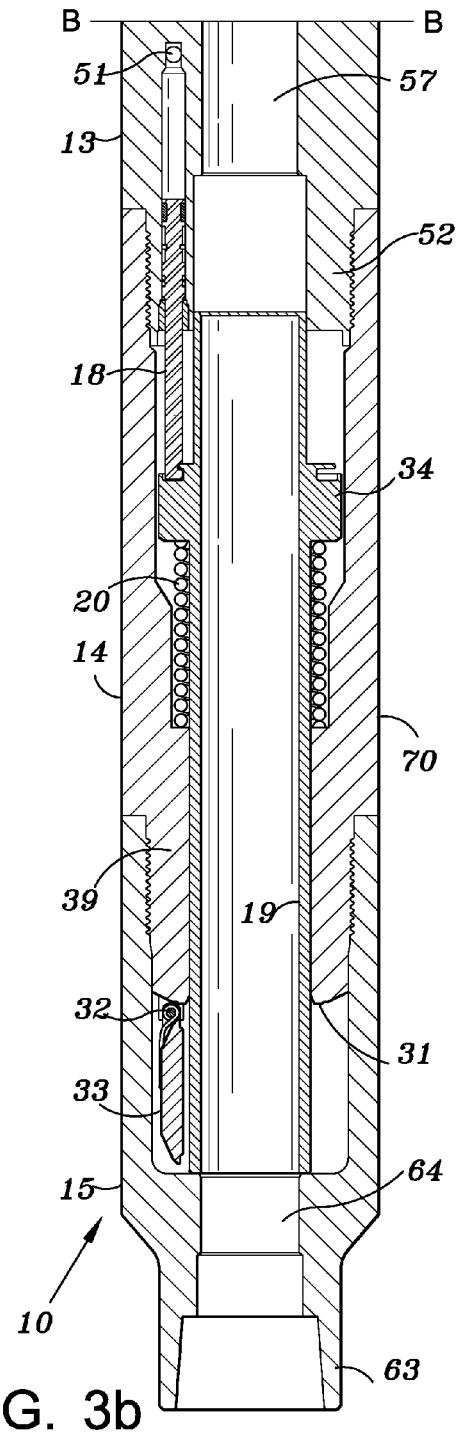

Referring to FIG. 1, an embodiment of the present invention is illustrated. The integral multiple stage safety valve includes five tubular sections 11, 12, 13, 14 and 15 connected to each other by any suitable known methods such as internal and external threads. Upper connection body 11 may be connected to any tubular to be placed within the well. A first spring housing 12 is connected at one end to the upper connection body and at the other end to an integral chamber housing 13 which interconnects the two separate safety valves 60 and 70 as shown in FIGS. 2*a* and 2*b* according to an embodiment of the invention. Housing 13 includes an interior flow path 57 of substantially constant diameter and generally equal to the interior diameter of sleeve 19. Second spring housing 14 is connected to a reduced diameter portion 52 of the integral chamber housing 13 by threads as an example. Lower connection body 15 is attached by any known manner to a reduced diameter portion 39 of second spring housing 14 at one end and may be connected to a tubular at its lower end 63. This design results in four body joints.

As shown in FIGS. 4 and 5, each safety valve includes a piston 18, a sleeve 19 with an enlarged connection portion 34, a flapper valve element 33 pivotably connected at 32 to the spring housing, a coil spring 38 that biases the flapper valve element against a valve seat 31 and a coil spring 20 that surrounds sleeve 19.

As shown in FIG. 4, a conventional mechanism for operating each safety valve includes a piston 18 having a seal 55 on its outer surface. Piston 18 at its lower end is received by an enlarged connection portion of sleeve 19. Spring 20 abuts a shoulder 56 on the sleeve 19 and is captured at its other end within spring housing 12 as shown at 61 in FIG. 5.

Figure 3A:
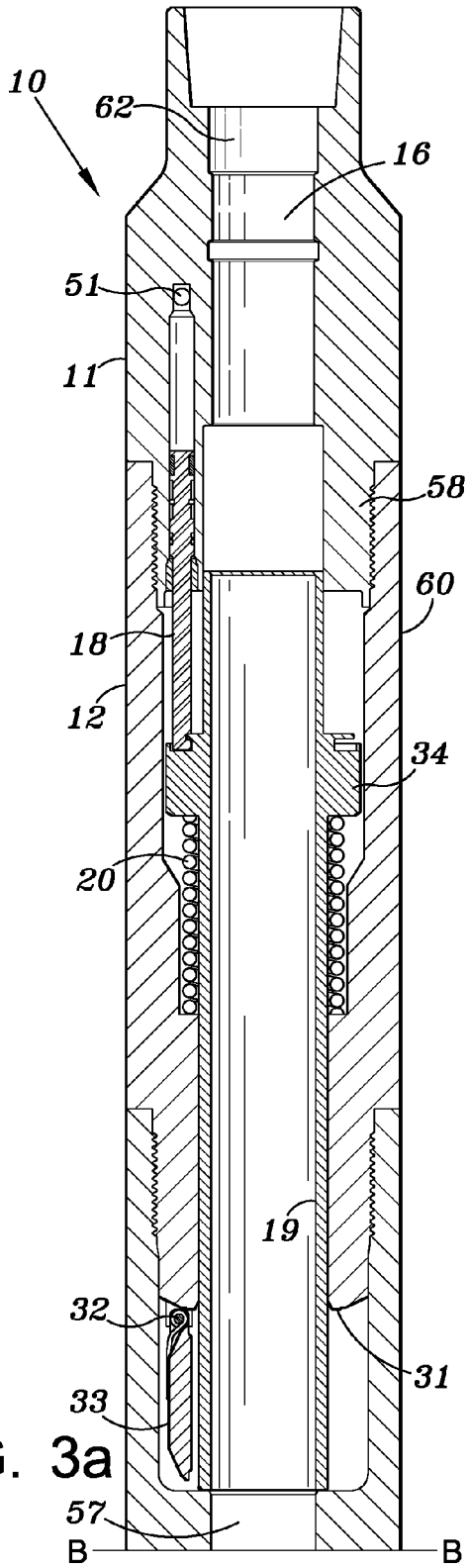

Pressurized hydraulic fluid may be introduced above piston 18 at inlets 51 by separate conduits that extend to the surface. Fluid introduced above piston 18 will cause piston 18 to move downwardly as shown in FIG. 1, while compressing spring 20 as shown in FIG. 3*a*. The lower end of sleeve 19 will push open flapper valve 33. Conversely, a decrease in the pressure will cause sleeve 19 to move upwardly by the force of the compressed spring which will cause flapper valve 33 to close thereby preventing any upward flow of fluid through the central passageway 16 of the safety valve. As discussed above safety valves 60, 70 may be independently operated by providing separate hydraulic lines for inlets 51.

FIG. 5 illustrates an example of a typical flapper valve that may be utilized with the invention. Lower portion 39 of spring housings 12 and 14 are provided with a valve seat 31. Flapper valve members 33 are pivotably connected at one side to the spring housings 12 and 14. The pivot 32 includes a coil spring 38 or the like which biases the valve member 33 against valve seat 31 as is known in the art.

Figure 6:
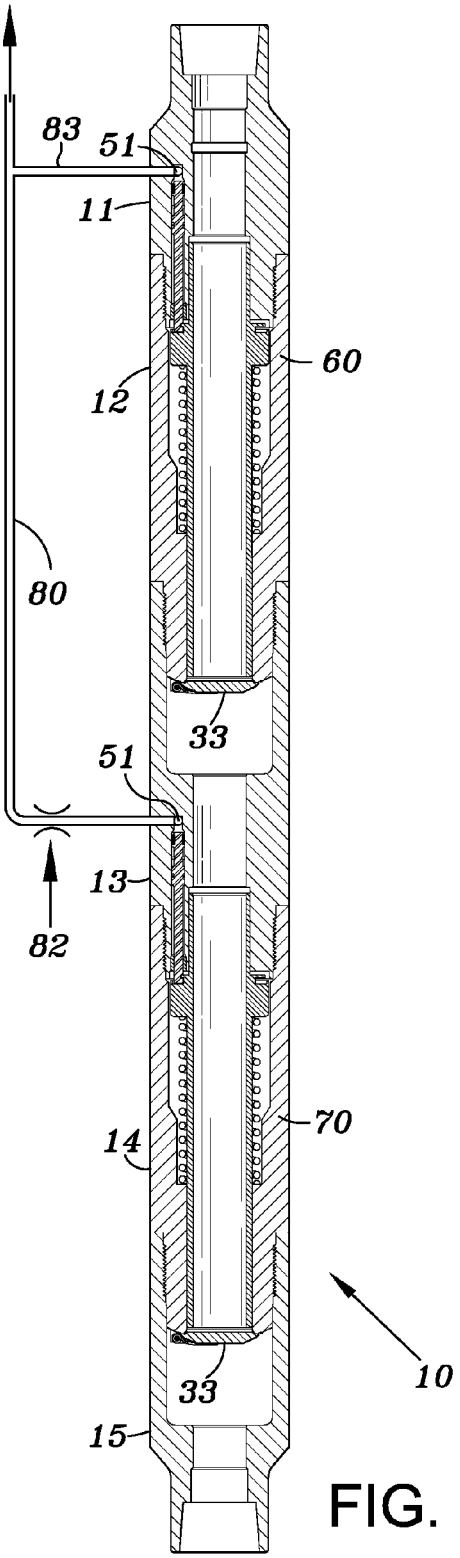
FIG. 6 is a cross sectional view of the safety valve having a single surface control line.
Figure 7:
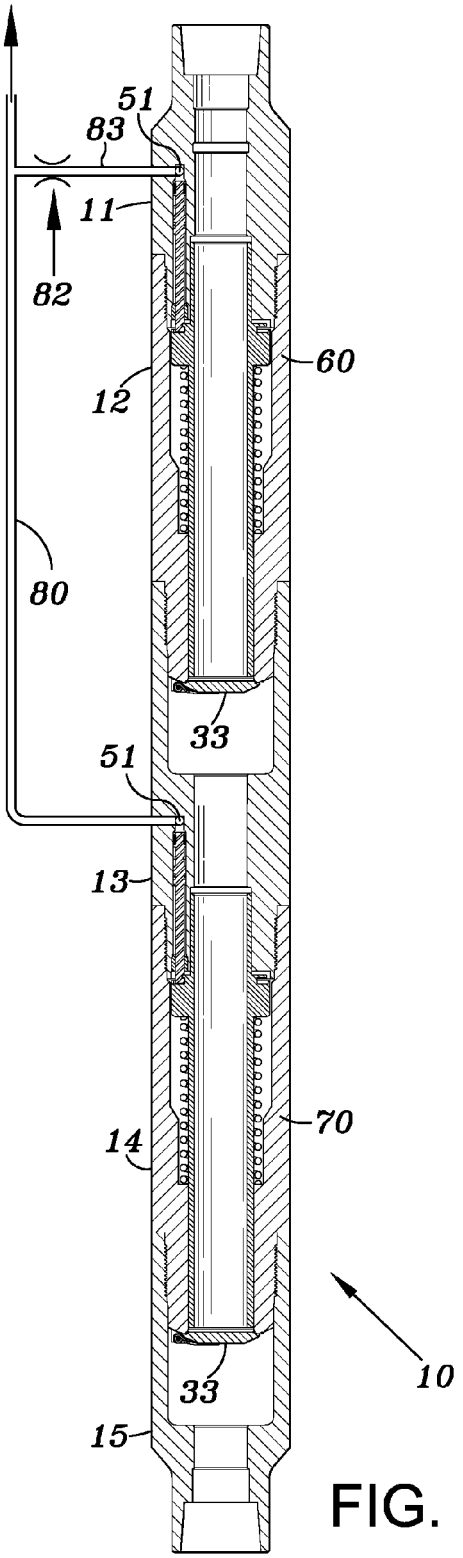
FIG. 7 is a view similar to FIG. 6 showing a flow restrictor in the control line branch going to the first valve.

As shown in FIG. 6, both valves may be activated by a single control line 80 that extends to the surface. A branch line 83 may extend to the inlet 51 of the upper valve 60 while line 80 connects to inlet 51 of lower valve 70. A flow restrictor 82 may be located in either branch line 83 or in flow line 80 downstream of branch line 83 as shown in FIG. 7 and FIG. 6 respectively. The positioning of flow restrictor 82 will delay opening of the valve as pressure is applied through control line 80. In the configuration shown in FIG. 6, valve 60 will open first followed by valve 70 and in the configuration shown in FIG. 7 valve 70 will open first followed by valve 60.

As pressure in the control line is reduced, the valve having the flow restrictor in its control line will close second while the other will close first.

Figure 8:
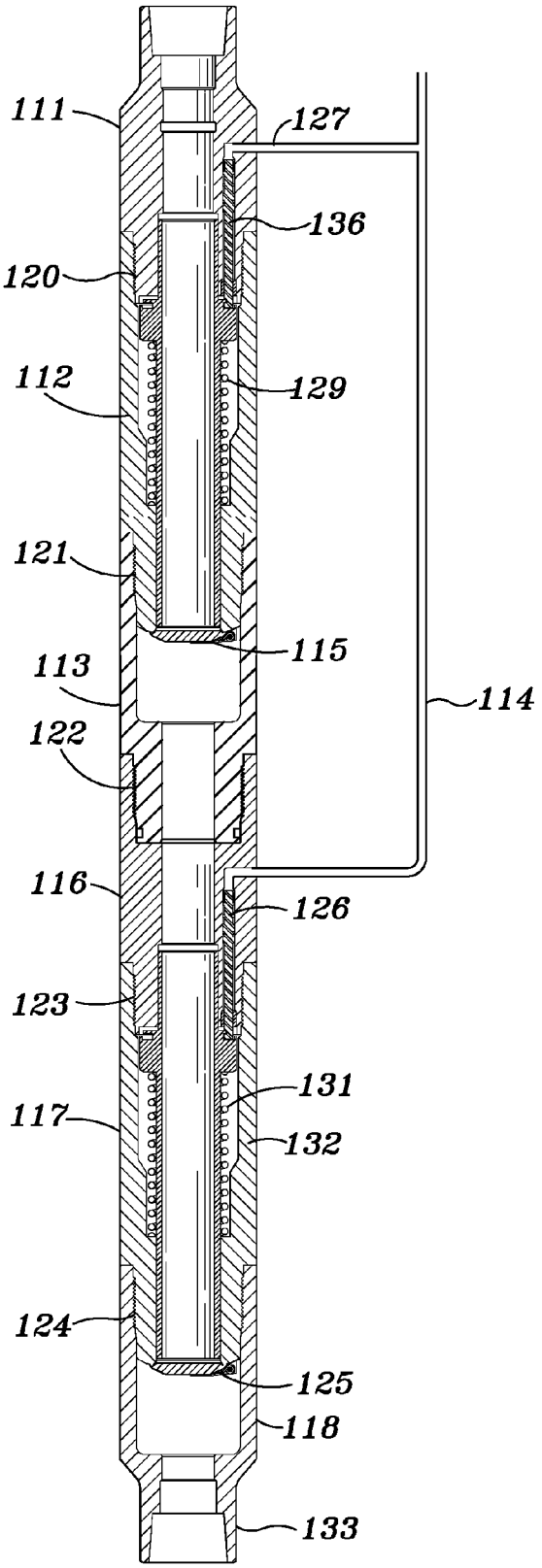
FIG. 8 is a cross-sectional view of a second embodiment of the invention.

FIG. 8 illustrates a second embodiment of the invention which includes two independent safety valves similar to those disclosed in FIG. 1 Each safety valve may include an actuator piston, a flow sleeve, a flapper valve element and a coil spring.

In this embodiment, the safety valve includes six tubular sections 111, 112, 113, 116, 117 and 118. First tubular section 111 has an upper portion which may be threadably connected to production tubing in a known manner.

The lower portion of first tubular member includes a piston chamber in which piston 136 is received. Fluid under pressure is introduced into the piston chamber via an inlet 127. Piston 112 acts on a flow sleeve 129 to open flapper valve 115 in the manner discussed above.

The second tubular section 112 is connected to tublar section 111 at a threaded joint 120. A third tubular section 113 is connected to second tubular section 112 at a threaded joint 121.

A fourth tubular section 116 also has a piston chamber in which is mounted a piston 126 which is adapted to move flow sleeve 131 which will open flapper valve 125 in the same manner as discussed above. A fifth tubular section 117 carries flow sleeve 131 and spring 132 and is connected to the fourth tubular section 116 by a threaded joint as shown it 123. Hydraulic lines 127 and 114 are connected to a source of hydraulic fluid under pressure at the well head.

A sixth tubular member 118 is connected to the fifth tubular section 117 at a threaded joint shown at 124. The lower portion of the sixth tubular member includes a threaded female connector adapted to receive a threaded portion of a production tubular.

Third tubular member 113 and fourth tubular member 116 in this embodiment form a chamber housing that consists of two tubular members.

The tubular members are connected together in a similar manner at 120, 121, 122, 123 and 124. Each joint includes a female threaded portion of the tubular member at its upper portion and a male threaded member at its lower end which is threadably connected to the female portion of the tubular member below it.

The outside diameter of the tubular members in the embodiments of FIGS. 1 and 8 are substantially the same as are the diameters of the inner flow passages. This embodiment results in five tubular joints.

Although the present invention has been described with respect to specific details, it is not intended that such details should be regarded as limitations on the scope of the invention, except to the extent that they are included in the accompanying claims.

We claim:

1. An integral multistage safety valve for an oil or gas well comprising:

a first valve including a spring housing having a valve seat at a lower end, and a sliding sleeve;

an integral chamber housing connected to the first valve at one end and having a first interior chamber that receives a lower end of the sliding sleeve and the valve seat of the first valve;

the integral chamber housing having an interior bore for slidably receiving a piston actuator; and a second valve having a spring housing and a sliding sleeve, the second valve connected to the integral chamber housing at a second end of the integral chamber housing, a portion of the sliding sleeve received within a second chamber of the integral chamber housing.

2. A valve according to claim 1 further including an upper connection body coupled to the first valve and a lower connection body coupled to the second valve, the upper connection body including as bore for receiving a piston actuator and the lower connection body surrounding a lower portion of the sliding sleeve and the valve seat of the second valve.

3. A valve according to claim 1 wherein the sliding sleeves of the valves and an internal flow passage of the integral chamber housing form a substantially constant diameter flow path when the valves are in the open position to substantially reduce turbulence and pressure loss.

4. A valve according the claim 1 wherein each valve includes a spring housing, a sliding flow sleeve, a piston connected to the sliding flow sleeve and a spring biasing the sliding flow sleeve in an upward direction.

5. A valve according to claim 4 wherein the valve further includes a flapper valve pivotably mounted on a downstream portion of the spring housing.

6. The valve according to claim 1 wherein the integral chamber housing includes two tubular members connected together.

7. An integral multistage safety valve for an oil or gas well comprising:

a first valve including a spring, housing;

a second valve including a second spring housing;

an integral chamber housing having an interior flow passage connected between the first and second valves, said valves being hydraulically operated by a single control line extending to the surface of the well, and a branch line extending to the first valve and a flow restrictor in the branch line or in the control line downstream of the branch line.

8. The valve according to claim 7 further including:

an upper connection member connected to the first valve; and a lower connection member connected to the second valve,

9. The valve according to claim 8 wherein the first and second valves, the integral chamber housing and the upper and lower connection members have interior flow passages of substantially the same diameter to reduce turbulence and pressure loss.

10. The valve according to claim 7 wherein the valves are independently operable.

11. The valve according to claim 10 including a hydraulically operated piston actuator for each valve and separate hydraulic hues for each piston actuator.

12. The valve according to claim 7 including no more than four body joints.

13. The valve according to claim 7 wherein said body joints are of the same thread form.

* * * * *